United States Patent [19]

Kosuge et al.

[11] Patent Number: 4,589,389

[45] Date of Patent: May 20, 1986

[54] FUEL INJECTION CONTROL APPARATUS FOR INTERNAL COMBUSTION ENGINES

[75] Inventors: Tokuo Kosuge, Nakamachi; Kimiji Karino, Katsuta, both of Japan

[73] Assignee: Hitachi, Ltd., Tokyo, Japan

[21] Appl. No.: 743,977

[22] Filed: Jun. 12, 1985

[30] Foreign Application Priority Data

Jun. 15, 1984 [JP] Japan ..... 59-121828

[51] Int. Cl.[4] ..... F02D 41/10

[52] U.S. Cl. ..... 123/326

[58] Field of Search ..... 123/325, 326, 492

[56] References Cited

U.S. PATENT DOCUMENTS

| | | | |
|---|---|---|---|
| 4,311,123 | 1/1982 | Glöckler et al. | 123/325 |
| 4,325,341 | 4/1982 | Yamauchi et al. | 123/472 |
| 4,414,941 | 11/1983 | Nakanishi | 123/326 |
| 4,452,212 | 6/1984 | Takase | 123/326 |

FOREIGN PATENT DOCUMENTS 59-28029 2/1984 Japan .

OTHER PUBLICATIONS

Bowler, "Throttle Body Fuel Injection—An Integrated Engine Control System", SAE Technical Paper Series, Feb. 25–29, 1980.

*Primary Examiner*—William A. Cuchlinski, Jr.
*Attorney, Agent, or Firm*—Antonelli, Terry & Wands

[57] ABSTRACT

A base injection pulse for regulating an injecting time of an injector is determined by the number of revolutions of an engine and the quantity of an intake air. The base injection pulse is calibrated or compensated as follows;

$$T_i = T_p(1 + K_a + K_b)$$

wherein $T_i$: a pulse width of the calibrated injection pulse, which determines the injecting time of the injector;

$T_p$: a pulse width of the base injection pulse;

$K_a$: a calibration coefficient determined by the level of an acceleration; and $K_b$: a calibration coefficient determined by the level of a deceleration preceding to the acceleration.

4 Claims, 2 Drawing Figures

FUEL INJECTION CONTROL APPARATUS FOR INTERNAL COMBUSTION ENGINES

BACKGROUND OF THE INVENTION

1. Field of the Invention

The present invention relates to an fuel injection control apparatus for internal combustion engines, more particularly to an electronic control apparatus for the fuel injection system in which an injector is located before the branching point of intake manifolds to commonly supply the fuel to all or a plurality of cylinders of the internal combustion engine.

2. Description of the Related Art

In the fuel injection system of the internal combustion engine, the amount of the fuel to be injected is extremely reduced upon the deceleration of the engine, or the supply of the fuel is stopped. This is for the purpose of the reduction of hydrogen carbonate in the exhaust gas and the improvement of the fuel consumption rate.

Namely, in the fuel injection system of the type in which the injector is positioned before the branching point of the intake manifolds led to every cylinders, the distance of the manifold between the injector and the respective cylinders becomes relatively long. During the operation of the engine, therefore, the fuel particle atomized by the injector adheres to the inner walls of the manifolds to form a fuel film storage thereon. If, under these conditions, the deceleration begins with the usual fuel control in the operation, almost of the fuel film storage is sucked into a combustion chamber of the engine so that the mixture of the air and fuel becomes temporarily too rich.

In order to avoid the occurrence of the phenomenon stated above, the amount of the fuel to be injected is extremely reduced or the supply of the fuel is stopped, when the engine is decelerated. According to such measures as the reduction or cutting off of the fuel, however, the fuel film storage evaporates so perfectly that the manifold walls become dry.

By the way, as the measures for the transition such as the rapid acceleration, the acceleration enrichment concept is known (cf. SAE Technical Paper Series 800164 "Throttle Body Fuel Injection (TBI)-An Integrated Engine Control System", page 12, right-hand column, first para. "Transient Fuel (Acceleration Enrichment)"). It is stated in this paper that extra fuel is needed for the manifold filling dynamics and the fuel film storage on the manifold walls.

In case, however, the engine is accelerated again immediately after it has been decelerated, the acceleration enrichment under the concept described in this paper is insufficient. That is to say, the degree of dryness of the manifold walls is closely related with the degree or level of the deceleration done precedingly to the acceleration. The greater or higher the degree or level of the deceleration is, the drier the manfold wall becomes. Accordingly, if the deceleration is of very high level, the manifold wall becomes very dry. As a result, upon the succeeding acceleration the greater part of the injected fuel which includes the acceleration enrichment component of the fuel is used only to wet the surface of the inner wall of the manifold, so that the fuel mixture becomes lean. This causes an increase in the contents of noxious components of the exhaust gas, and an acceleration delay.

SUMMARY OF THE INVENTION

An object of the present invention is to provide a fuel injection control apparatus which is capable of preventing the fuel mixture from becoming lean, even when the engine is accelerated immediately after it has been decelerated with the fuel injection rate reduced to an extremely low level or almost zero.

The characteristics of the present invention reside in that an additional acceleration enrichment of the fuel is carried out, when the engine is accelerated immediately after it has been decelerated with the fuel injection rate reduced to an extremely low level or substantially to zero, in accordance with the degree of the deceleration and in addition to a regular acceleration enrichment.

DETAILED DESCRIPTION OF THE PREFERRED EMBODIMENT

Figure 1:
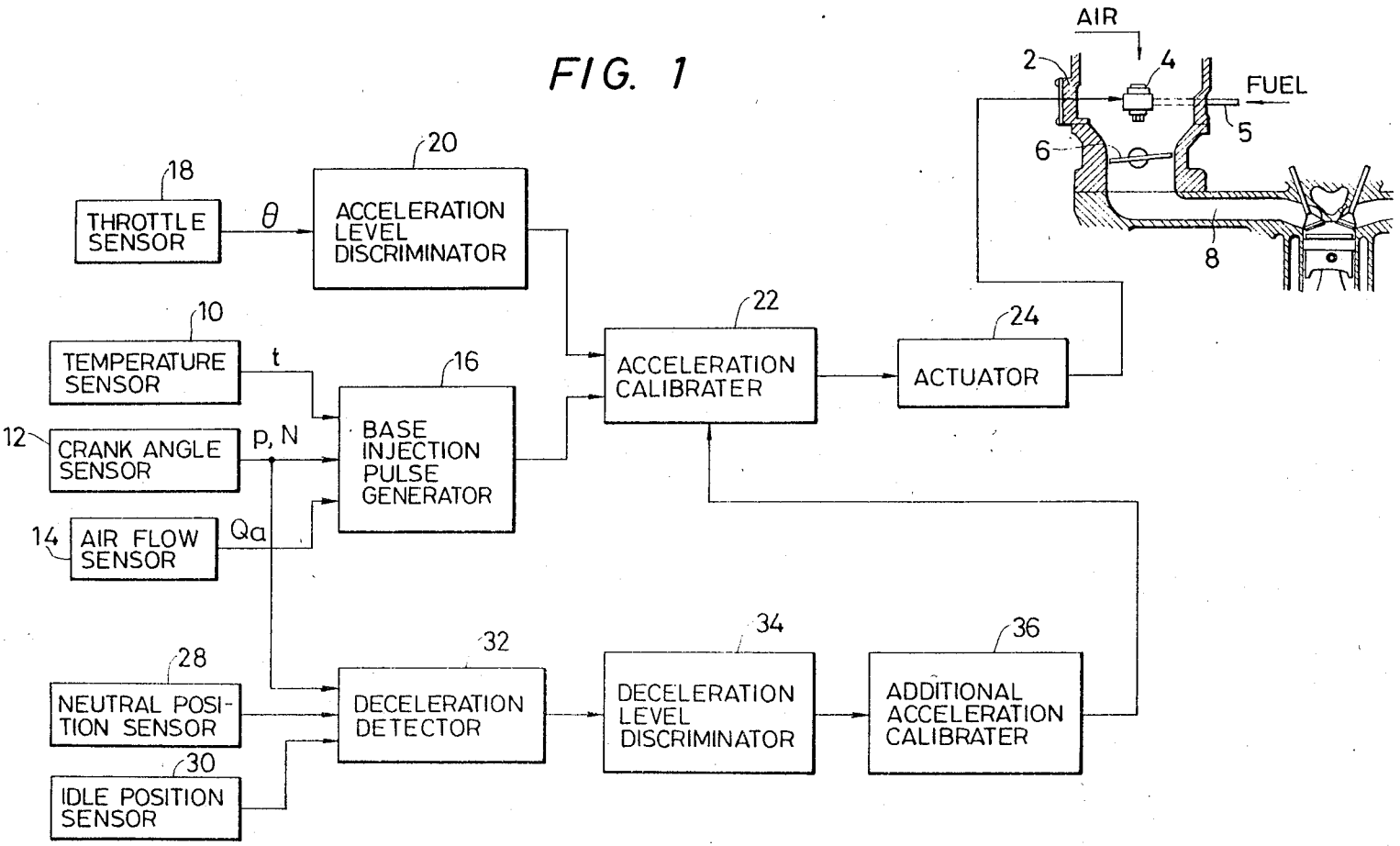
FIG. 1 shows a block diagram of an embodiment of the fuel injection control apparatus according to the present invention.

Referring to FIG. 1, a reference numeral 2 denotes a throttle body, in which an injector 4 and a throttle valve 6 are installed by known supporting members. Fuel is supplied to the injector 4 through a fuel pipe 5. The injector 4 atomizes the fuel in accordance with a signal from a control apparatus described after. The atomized fuel is supplied to a cylinder of the engine through an intake manifold 8 with air. In this figure, only one cylinder and the manifold 8 connected between the cylinder and the throttle body 2 are shown, but, as usual, there are plural cylinders and manifolds connecting the throttle body 2 with the corresponding cylinder. The mixture of the air and the fuel atomized by the injector 4 is sucked into the cylinder under the condition of the suction process through the corresponding manifold. The injector 4 has to inject the fuel in synchronism with the suction process of every cylinders.

The control apparatus for the injection system as described above is constructed as follows. Namely, in the figure, a temperature sensor 10 detects the temperature of the cooling water of the engine to produce an output signal t. A crank angle sensor 12 is built in a distributor (not shown) and detects the angle of a crank shaft thereby to output a signal having an information of the angular position of the crank shaft p and the number of revolutions of the engine N. An air flow sensor 14 is arranged in the throttle body 2 to measure the quantity of the intake air of the engine and produce a signal Qa corresponding to the measured quantity.

These signals t, N and Qa are sent to a base injection pulse generater 16, which decides the width of the injection pulse in accordance with the signals mentioned above. During the time of the pulse width, the injector 4 executes the injection of the fuel. The repetion frequency of the injection pulse depends on the output N of the crank angle sensor 12. The pulse width is determined by selecting one value from the matrix representing the pulse width in accordance with the number of revolutions of the engine N and the quantity of the intake air Qa, i.e. the load of the engine. The thus obtained injection pulse can be calibrated by the signal t from the temperature sensor 10 for the cold operation. For the purpose of the determination of the base injection pulse, the concentration of oxygen contained in the exhaust gas may be taken into consideration, which is detected by an oxygen sensor installed in an exhaust manifold. But, the present invention has nothing to do with how to decide the base injection pulse. Therefore, the further description about the method of determination of the base injection pulse is omitted. This invention is appliable to all the method that determines the base injection pulse on a basis of the signals of parameters representing the fundamental condition of the engine, such as the number of revolutions of the engine, the angular position of the crank shaft, the quantity of the intake air, the temperature of the cooling water and so on, as described before.

In case the operation of the engine is of steady state, the base injection pulse thus obtained is sent to an actuator 24, passing through an acceleration calibrater 22 which is described in detail later. If, however, the engine is accelerated, the compensation or calibration is done against the base injection pulse. First of all, the opening of the throttle valve 6 is detected by a throttle sensor 18. The opening signal $\theta$ is given to an acceleration level discriminator 20, in which the acceleration level is judged. The acceleration level is represented by the variation rate of the opening ($d\theta/dt$). The larger the value $d\theta/dt$ is the higher the acceleration level is. The acceleration level signal $d\theta/dt$ is sent to the acceleration calibrater 22, where the calibration or compensation for $d\theta/dt$ is executed against the base injection pulse. The calibration or compensation is added, for example, to the pulse width of the base injection pulse, as follows;

$$T_c = T_p(1+K_a)$$

wherein $T_c$: a pulse width of the calibrated injection pulse, which is the output of the acceleration calibrater 22;

$T_p$: the pulse width of the base injection pulse output from the base injection pulse generater 16; and $K_a$: a calibration coefficient determined in accordance with the discriminated acceleration level.

The signal with the pulse width $T_c$ is given to the actuator 24, which actuates the injector 4. Since the injector 4 is supplied with the fuel of the constant pressure, it injects the fuel of the amount in accordance with the pulse width $T_c$. The amount of the fuel corresponding to $T_p \cdot K_a$ in the whole injected fuel means the acceleration enrichment described before. This acceleration enrichment is called "a regular acceleration enrichment" hereinafter, since this enrichment is obtained for the usual acceleration operation of the engine. Here, the usual acceleration means the acceleration which is conducted successively from the steady operation of the engine, or which is in process of the continuing acceleration.

If, different from that, the deceleration has been done immediately before the acceleration, the further calibration or compensation is executed against the above-mentioned calibrated injection pulse, as described hereinafter.

A neutral position sensor 28 detects that a transmission (not shown) is in the neutral position and outputs a signal to a deceleration detector 32. An idle position sensor 30 detects that the throttle valve 6 is in the idle position and produces an output signal t to the deceleration detector 32. Receiving the signal of the number of revolutions of the engine as well as the signals both of the neutral position of the transmission and the idle position of the throttle valve, the deceleration detector 32 detects that the engine is in the deceleration condition. The level of the deceleration is judged by a deceleration level descriminator 34. The deceleration level is represented by the variation rate (dN/dt) of the number of the revolutions of the engine. The greater the value dN/dt is, the higher the decelerations level is.

The deceleration level signal is sent to an additional acceleration calibrater 36, in which the coefficient $K_b$ for the additional calibration or compensation is determined in accordance with the deceleration level. The coefficient $K_b$ is supplied to the acceleration calibrater 22, in which the following calibration or compensation is made;

$$T_i = T_p(1+K_a+K_b)$$

wherein $T_i$ denotes the pulse width of the finally calibrated injection pulse, which becomes an input of the actuator 24. The fuel amount corresponding to $T_p \cdot K_b$ in the whole injected fuel is referred to as "an additional acceleration enrichment" hereinafter.

As is apparent from the above description, it can be said that the acceleration enrichment according to the present invention includes the component of the additional acceleration enrichment depending on the level of deceleration just before the acceleration, as well as the component of the regular acceleration enrichment depending on the level of the re-acceleration which succeeds the deceleration.

In FIG. 1, the embodiment of the present invention is shown so as to be constructed by separate and independent devices or apparatuses. Practically, the functions achieved by the respective devices or apparatuses shown in the figure are performed by an electronic data processor with suitable interferences, except the various kind of sensors 10, 12, 14, 18, 28 and 30 and the actuator 24.

Figure 2:
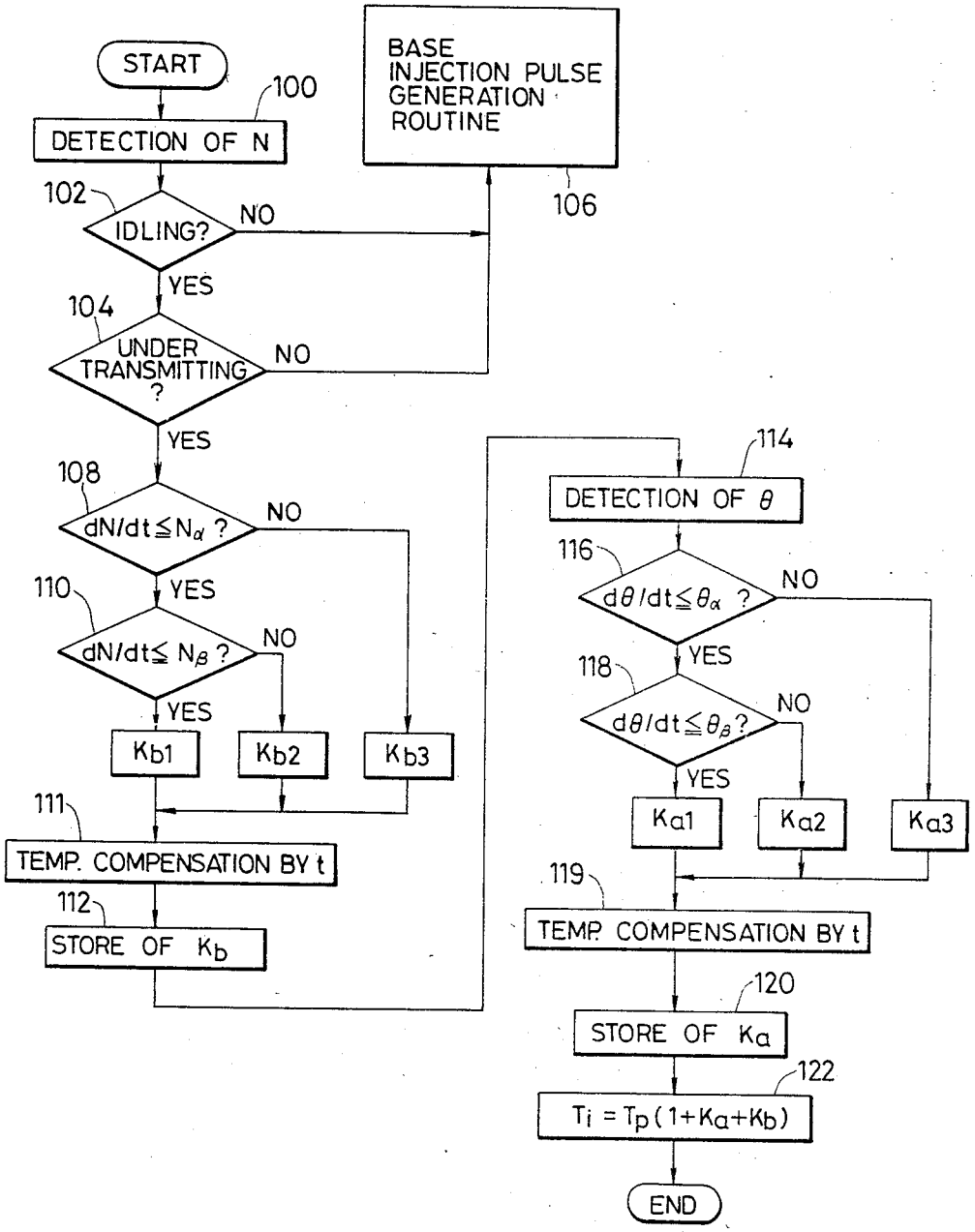
FIG. 2 is a control flow chart for explaining the operation of the embodiment shown in FIG. 1.

Referring to FIG. 2, the explanation is made of the operation in case the control apparatus is constructed by such a processor.

First of all, the number N of revolutions of the engine is detected at a step 100. At steps 102 and 104, it is judged whether the engine is in the decelerated state or not. If not, the control flow jumps to a base injection pulse generation routine 106. As already stated before, the applicability of the present invention is not limited to any particular method of the generation of the base injection pulse itself. Therefore, the details of this routine 106 is omitted here, for the purpose of the conciseness or simplicity of the description.

When the engine is in the deceleration, the level of dN/dt is descriminated at steps 108 and 110. In this case, two reference values $N_\alpha$ and $N_\beta$ ($N_\alpha > N_\beta$) for the deceleration level are preset and three coefficients $K_{b1}$, $K_{b2}$ and $K_{b3}$ are provided for the calibration or compensation on a basis of the deceleration level. If, $dN/dt > N_\alpha$, the coefficient $K_{b3}$ is selected. In a case of $N_\alpha \geqq dN/dt > N_\beta$, the coefficient $K_{b2}$ is chosen. Further, if $dN/dt \leqq N_\beta$, the coefficient $K_{b1}$ is selected. The selected coefficient $K_b$ can be compensated by the temperature t of the cooling water, if necessary, as shown at a step 111. In this case, the temperature compensation is so made that the higher the temperature of the cooling water is, the less the amount of the injected fuel becomes. The thus determined coefficient $K_b$ is stored in a storage at a step 112. Here, the number of the calibration coefficient $K_b$ is not limited to three, but it can be selected in the given number as occasion demands.

In this way, during the engine is in the deceleration condition, the deceleration level is always descriminated and the coefficient of calibration according to the deceleration level is stored. From such a condition, if the acceleration is demanded, that fact is catched as a change in the opening $\theta$ of the throttle valve 6. Therefore, the opening $\theta$ is detected at a step 114 and the acceleration level $d\theta/dt$ is discriminated at steps 116 and 118. The discrimination of the acceleration level is done in the same way as that of the deceleration level. Namely, two reference values $\theta_\alpha$ and $\theta_\beta$ ($\theta_\alpha<\theta_\beta$) for the opening of the throttle valve 6 are preset and three coefficients $K_{a1}$, $K_{a2}$ and $K_{a3}$ are provided for the calibration or compensation in accordance with the discriminated acceleration level. In a case of $d\theta/dt>\theta_\alpha$, the coefficient $K_{a3}$ is picked, the coefficient $K_{a2}$ in a case of $\theta_\alpha \geqq d\theta/dt>\theta_\beta$, and the coefficient $K_{a1}$ in a case of $d\theta/dt \leqq \theta_\beta$. The thus decided coefficient $K_a$ is stored at a step 120. Similary to a case of the calibration coefficient $K_b$, the number of calibration coefficient $K_a$ for the acceleration is not limited to three, but it can be provided arbitrarily as occasion demands.

On a basis of the coefficients $K_b$ and $K_a$ stored at the steps 112 and 120, the calibration or compensation is executed at a step 122. As a result, the calibrated injection pulse is obtained which includes, as its component, the regular acceleration enrichment and the additional acceleration enrichment.

In the embodiment mentioned above, the judgement of the acceleration and the deceleration is performed by the degree of the opening of the throttle valve and the number of revolutions of the engine. However, the variation rate of the quantity $Q_a$ of the intake air or the negative pressure $P_v$ of the intake manifold can be also utilized for that purpose. In this case, therefore, $dQ_a/dt$ or $dP_v/dt$ is used for judging the level of the acceleration or deceleration.

According to the present invention described above, the fuel can be injected at an optimum rate when the engine is accelerated immediately after it has been decelerated with the fuel injection rate reduced to an extremely low level or to zero. Therefore, an increase in the contents of noxious components in the exhaust gas as well as acceleration delay can be prevented.

We claim:

1. A fuel injection control apparatus for an internal combustion engine, in which the base amount of an fuel to be injected is regulated by a base injection pulse obtained in accordance with fundamental parameters representing the operational condition of the engine, and it is reduced to an extremely low level or substantially zero when the engine is decelerated and, upon a re-acceleration succeeding the deceleration, calibrated by an acceleration enrichment determined by a level of the re-acceleration, characterized by an additional acceleration enrichment means for further calibrating the amount of the fuel to be injected in response to the level of the deceleration preceding to the re-acceleration.

2. A fuel injection control apparatus as defined in claim 1, wherein said level of the deceleration is discriminated by the decreasing rate of the number of revolutions of the engine.

3. A fuel injection control apparatus as defined in claim 1, wherein an injecting time $T_i$ of an injector calibrated by said acceleration enrichment and said additional acceleration enrichment is as follows;

$$T_i=T_p(1+K_a+K_b)$$

wherein $T_p$: the injecting time on a basis of the base injection pulse;

$K_a$: a calibration coefficient determined in accordance with the acceleration level; and $K_b$: a calibration coefficient determined by the level of the deceleration preceding to the acceleration.

4. A fuel injection control apparatus as defined in claim 3, wherein at least one of the calibration coefficients $K_a$ and $K_b$ is so preset that the amount of the fuel to be injected is reduced as the temperature of a cooling water of the engine rises.

* * * * *